US006732479B2

(12) United States Patent
Nomura et al.

(10) Patent No.: US 6,732,479 B2
(45) **Date of Patent: *May 11, 2004**

(54) MOVABLE DEFENSIVE APPARATUS

(75) Inventors: Yasuhiro Nomura, 502 Maison Riviere, 2-15-13 Nishikawa, Amagasaki-shi Hyogo-ken (JP); Kazuo Yano, 898-9 Shinmachi, Yamato Kooriyama-shi, Nara-ken (JP)

(73) Assignees: Kazuo Yano, Kooriyama (JP); Yasuhiro Nomura, Amagasaki (JP)

( * ) Notice: Subject to any disclaimer, the term of this patent is extended or adjusted under 35 U.S.C. 154(b) by 56 days.

This patent is subject to a terminal disclaimer.

(21) Appl. No.: 10/025,992

(22) Filed: Dec. 26, 2001

(65) Prior Publication Data

US 2002/0083651 A1 Jul. 4, 2002

(30) Foreign Application Priority Data

Dec. 27, 2000 (JP) ..... 2000-398052

(51) Int. Cl.[7] ..... E04B 1/346

(52) U.S. Cl. ..... 52/64; 52/1; 52/169.3; 52/DIG. 12; 405/87; 405/104; 256/13

(58) Field of Search ..... 52/64–169.1, 169.2, 52/169.3, DIG. 12; 405/87, 104; 49/50; 256/13, 73

(56) References Cited

U.S. PATENT DOCUMENTS 3,796,010 A * 3/1974 Carlson ..... 49/477
5,460,462 A * 10/1995 Regan ..... 405/96
5,943,832 A * 8/1999 Russell ..... 52/202
6,029,405 A * 2/2000 Wood ..... 52/2.23
6,338,594 B1 * 1/2002 Adler et al. ..... 405/97
6,425,707 B1 * 7/2002 Baxter ..... 405/87
6,514,011 B2 * 2/2003 Nomura et al. ..... 405/107

* cited by examiner

*Primary Examiner*—Carl D. Friedman
*Assistant Examiner*—Chi Q. Nguyen
(74) *Attorney, Agent, or Firm*—Armstrong, Kratz, Quintos, Hanson & Brooks, LLP

(57) ABSTRACT

The present invention provides a movable defensive apparatus in which a dedicated source of power for driving a relatively heavy defensive wall and an installation space are not required, whereby entry of a mob, a runaway vehicle, and the like, can be prevented, the entry of rainwater, and the like, can also be prevented to some extent. The movable defensive apparatus includes a defensive wall (2) disposed in the vicinity of a doorway (O•I) of a site (G), such as a house, and an installation in the vicinity of a doorway (O•I), a window or the like, of a building for preventing rainwater and undesirable entry of objects, such as a mob or a runaway vehicle from entering the site (g) or a building. Also described is a piston cylinder unit (20, 20) which is operated by running water for driving the defensive wall (2) from a machine room (M•R) to a predetermined upper position along a guide device (10, 10).

6 Claims, 2 Drawing Sheets

2 (A)

2 (B)

MOVABLE DEFENSIVE APPARATUS

BACKGROUND OF THE INVENTION

1. Field of the Invention

The present invention relates to a movable defensive apparatus comprising a defensive wall disposed in the vicinity of a doorway of a site such as a house and an installation or in the vicinity of a doorway, a window or the like of a building for preventing rainwater and illegal object such as a mob and a runaway vehicle from entering the site or the building; and a drive device for driving the defensive wall from a storage position to a predetermined position along a guide device.

2. Description of the Prior Art

As is known, a fence is fixed around a site such as a house and an installation. A break of the fence is selected by a doorway, and the doorway is provided with a gate which is manually opened and closed. A vestibule of the building is also provided with, e.g., an open/close door which is manually opened and closed.

There is a conventionally proposed movable waterproofing apparatus for preventing river water, rainwater and the like from entering a house or a site. The movable waterproofing apparatus comprises a float and a waterproofing plate mounted to the float. If the river or the like is swollen, the float floats, and the waterproofing plate stands up by this buoyant force, thereby preventing river water, rainwater or the like from entering the house. For example, Japanese Patent Application Laid-open No. H2-240312 proposes a movable bank for preventing inundation of river at the time of flood. The movable bank generally comprises a rotation shaft provided above a top end of the bank, a plurality of arms extending from the rotation shaft, a plurality of breast-plates each having a predetermined area and mounted to the arm, and electric drive device for driving the breast-plates. Therefore, it is possible to rotate the arms of the electric drive device to rotate the breast-plates to add height of the bank when necessary. With this feature, the height of the bank is increased, and the inundation at the time of flood can be prevented.

As described above, since the conventional doorway of the site or building is provided with the gate which can be opened and closed or the open/close door, it is possible to passably prevent a trespasser by the gate or door. In the case of the conventional general door, however, it is not possible to prevent a mob, a runaway vehicle and the like because of its structure. It may be effective to provide the door with structural rigidity and to provide a defensive wall which is effective against the runaway vehicle and the like. It is expected that such a defensive wall is heavy, and an electric motor or a hydraulic drive device is used for driving the defensive wall. Therefore, it is possible to house the defensive wall in a shelter using the electric motor or the hydraulic drive device, and to drive the defensive wall to a necessary place in case of an emergency.

When police or social order is destroyed by mob or the like, or in case of an emergency such as a disaster, electric supply may be cut off at an initial stage. If the electric supply is cut off, the defensive wall can not be driven. A manually movable drive device may additionally be provided, but it is difficult to drive a heavy defensive wall manually, and it may of no use in case of an emergency.

The above-described conventional movable waterproofing apparatus can prevent flood and inundation of river, and may prevent a trespasser from entering to some extent. However, installation place of the waterproofing plate is limited to a bank and the like, and although the conventional movable waterproofing apparatus can prevent the flood, but doubt remains as to prevent mob from entering. Further, the drive device is constituted by the float, there is a defect that the installation place is limited.

SUMMARY OF THE INVENTION

It is an object of the present invention to provide a movable defensive apparatus in which the above-described conventional problem and drawback and more specifically, to provide a movable defensive apparatus in which power for driving a relatively heavy defensive wall and installation space are not required specially, entry of mob, runaway vehicle and the like can be prevented of course, and entry of rainwater and the like can also be prevented to some extent.

The above object of the present invention is achieved by applying the running water for driving the defensive plate. In generally, a building is provided with a reserved water tank such as a feed tank and a disaster prevention tank. Therefore, water in the reserved water tank is utilized to achieve the object. If the water in the reserved water tank is utilized, in case of an emergency when running water can not be obtained, the defensive plate can be driven. According to a first aspect of the present invention, there is provided a movable defensive apparatus comprising a defensive wall disposed in the vicinity of a doorway of a site such as a house and an installation or in the vicinity of a doorway, a window or the like of a building for preventing rainwater and illegal object such as a mob and a runaway vehicle from entering the site or the building; and a drive device for driving the defensive wall from a storage position to a predetermined position along a guide device, wherein the drive device comprises a piston cylinder unit which is operated by water pressure such as running water and reserved water.

According to a second aspect of the invention, the defensive wall of the first aspect is provided in the vicinity of the doorway between a fence and another fence surrounding the site. According to a third aspect of the invention, the defensive wall of the first aspect is provided in the vicinity of an open/close portion such as a door of the doorway and a window of the building. According to a fourth aspect, the storage position of the defensive wall of the first to third aspects is a basement. According to a fifth aspect of the invention, the storage position of the defensive wall of the second aspect is a side surface of the fence. According to a sixth aspect of the invention, the piston cylinder unit of the first to fifth aspects is of telescopic type. According to a seventh aspect of the invention, a valve for controlling running water, reserved water or the like to be supplied to the piston cylinder unit of the first to sixth aspects is provided in the building.

DESCRIPTION OF THE PREFERRED EMBODIMENTS

Figure 1:
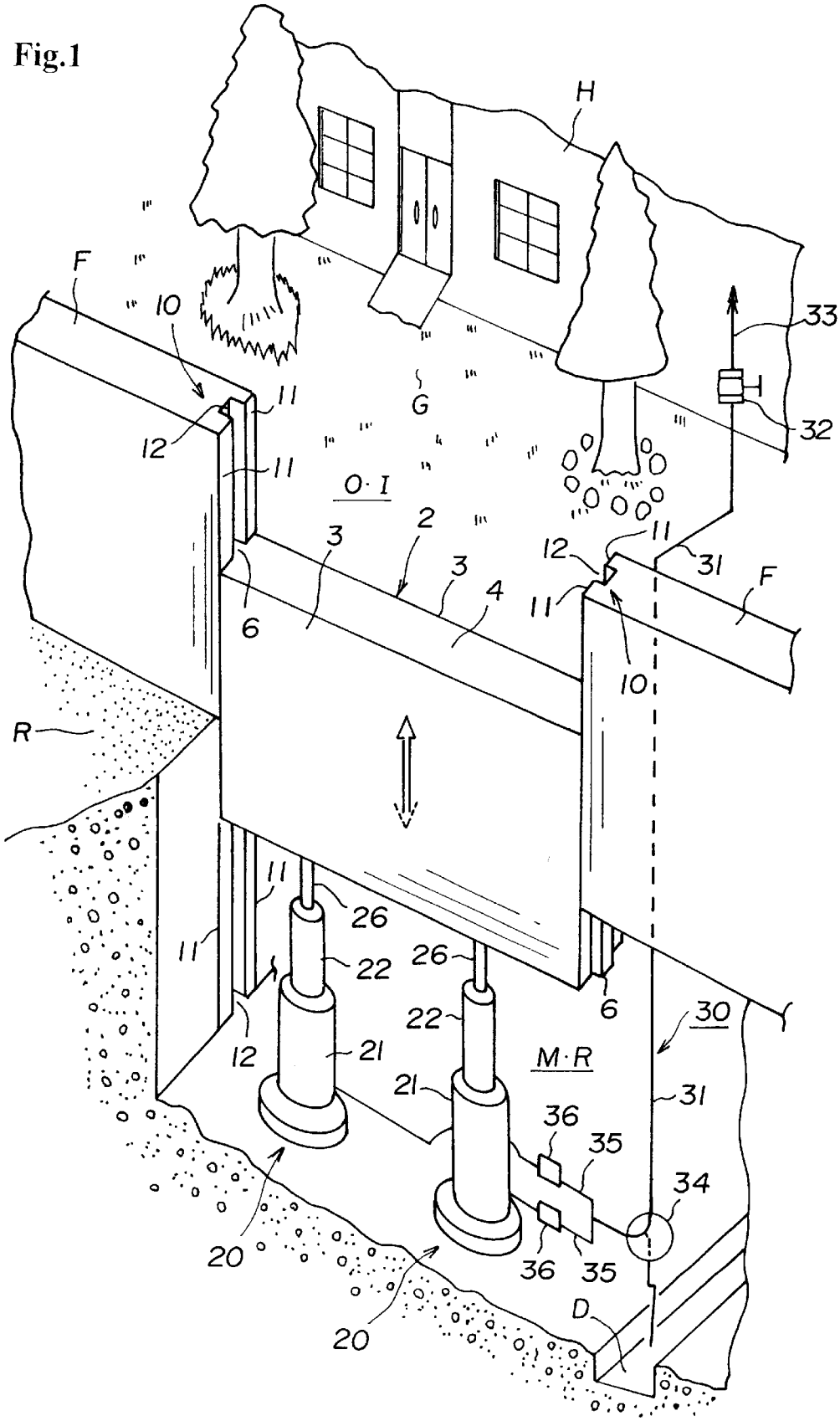
FIG. 1 is a schematic perspective view showing a first embodiment of the present invention.

Embodiments of the present invention will be explained with reference to the accompanying drawings below. A movable defensive apparatus 1 according to the invention can easily be understood from later-described embodiment, and comprises a plurality of defensive walls connected to one another with slight sideplay therebetween. A plurality of water pressure type piston cylinder units may be applied to the movable defensive apparatus 1. In the following description, an embodiment in which one defensive wall 2 is used will be explained. FIG. 1 is a schematic perspective view showing a first embodiment of the present invention. As will be understood from FIG. 1, the movable defensive apparatus 1 of the first embodiment includes the defensive wall 2. The defensive wall 2 is usually stored in an underground machine rooms M•R, and is driven to an upper predetermined position in case of an emergency.

According to the embodiment shown in FIG. 1, a site G is surrounded by fences F and F having predetermined height, and a building H is erected in the site G. The fences F and F are provided at their necessary portions with gaps or openings. The opening is selected as a doorway O•I into the site G for example, and the doorway O•I is closed by the defensive wall 2 in case of an emergency. The underground machine rooms M•R is formed in a position corresponding to the doorway O•I. The defensive wall 2 and later-described first and second water pressure type piston cylinder units 20 and 20 are stored in the machine rooms M•R. The basement M•R can also be utilized as a warehouse or the like other than equipment, of course.

The movable defensive apparatus 1 comprises the defensive wall 2, a pair of guide members 10 and 10 for slidably guiding the defensive wall 2, first and second water pressure type piston cylinder units 20 and 20 for driving the defensive wall 2 upward, and a feed water supply system 30 for supplying running water of predetermined water pressure to the water pressure type piston cylinder units 20 and 20.

Although the defensive wall 2 is not illustrated precisely in the perspective view of FIG. 1, in this embodiment, the defensive wall 2 is formed into a hollow substantially box-like shape comprising a pair of side plates 3 and 3 having predetermined areas, a pair of side portions having predetermined width, and a top 4 for closing an upper space formed by the side plates 3 and 3 and the side portions. The defensive wall 2 is formed at its opposite sides with convex guides 6 and 6 extending in the vertical direction. The defensive wall 2 is supported inside the machine rooms M•R by a support member or a stopper such that the height of the top 4 becomes the same as that of a road surface R.

According to this embodiment, since the defensive wall 2 is hollow, when the defensive wall 2 is driven downward, the first and second water pressure type piston cylinder units 20 and 20 get into the defensive wall 2. With this feature, the machine rooms M•R need not be deep. Further, since the defensive wall 2 is hollow, its weight is light. Therefore, the defensive wall 2 can be driven by the small first and second water pressure type piston cylinder units 20 and 20. Although the defensive wall 2 is light in weight, since a stay is fixed in the defensive wall 2, the defensive wall 2 has rigidity. Thus, the defensive wall 2 can sufficiently endure the mob, the runaway vehicle and the like. When the defensive wall 2 is lowered from an intermediate position shown in FIG. 1 to a normal position of the same height as that of the road surface R, an automobile can pass thereon.

Since the first and second water pressure type piston cylinder units 20 and 20 have the same structures, only the first water pressure type piston cylinder unit 20 will be explained. The first water pressure type piston cylinder unit 20 is formed into a telescopic structure. That is, according to the embodiment shown in FIG. 2(A), the water pressure type piston cylinder unit 20 is constituted by first and second water pressure cylinder 21 and 22. More specifically, the first water pressure type piston cylinder unit 20 comprises a first water pressure cylinder 21 fixed to the machine rooms M•R and having a relatively large diameter, a second water pressure cylinder 22 provided in the first water pressure cylinder 21 for reciprocating motion, a piston 25 provided in the second water pressure cylinder 22 for reciprocating motion, and a piston rod 26 formed integrally together with the piston 25. A bottom of the second water pressure cylinder 22 is formed with a through hole 24 and functions as a piston portion 23, and this piston portion 23 comes into close contact with an inner peripheral surface of the first water pressure cylinder 21 and the piston portion 23 reciprocate. An upper end of the piston rod 26 is fixed to the stay of the defensive wall 2 by means of a bolt or the like. If running water is supplied from a feed pipe 35, the running water supplied to a piston head chamber of the first water pressure cylinder 21 passes through the through hole 24, and is also supplied to a piston head chamber of the second water pressure cylinder 22. With this feature, although rising speed or lifting power and the like of the second water pressure cylinders 23 and the pistons 25 differ because of a difference in pressure-receiving surfaces of the piston 25 and the piston portion 23 of the second water pressure cylinder 22, and because of a difference in volume of the piston head chambers of the piston 25 and the piston portion 23, the piston rod 26 finally rises, and the defensive wall 2 is driven to the predetermined position.

As shown in FIG. 1, the feed water supply system 30 includes a feed pipe 31. One end of the feed pipe 31 is connected to a water supply pipe 33 through an open/close valve 32. A cross valve 34, a check valve and the like (not shown in FIG. 1) are provided on the other end of the feed pipe 31. According to this embodiment, since the two first and second water pressure type piston cylinder units 20 and 20 are provided, the feed pipe 31 is branched into two branch pipes 35 and 35. Orifices 36 and 36 are provided on the branch pipes 35 and 35, and the branch pipes 35 and 35 are respectively connected to the piston head chambers of the first water pressure cylinders 21 and 21 of the first and second water pressure type piston cylinder units 20 and 20. Since the orifices 36 and 36 are provided on the branch pipes 35 and 35 in this manner, if a difference in the rising position of the first and second water pressure type piston cylinder units 20 and 20 is generated, a difference in pressure of the piston head chambers of the first and second water pressure type piston cylinder units 20 and 20 is also generated due to a difference in driving force. If the difference is caused, a pressure difference between inlet side and outlet side of the orifices 36 and 36 is also changed. As a result, water amount flowing through the orifices 36 and 36 is changed. With this, the first and second water pressure type piston cylinder units 20 and 20 are driven with the same water amount and in the same manner.

According to this embodiment, the open/close valve 32 is disposed indoor. In case of the emergency, a user can to open the open/close valve 32 to supply the running water to the first and second water pressure type piston cylinder units 20 and 20, thereby driving the defensive wall 2 to the upward predetermined position from an indoor safe place without being exposed to danger. The cross valve 34 can also be disposed indoor. With this, the defensive wall 2 can be operated indoor. Since the check valve is provided, even if the supply of the running water is stopped by any reason, the defensive wall 2 is not lowered unintentionally. One of pipes of the cross valve 34 is opened at a ditch D.

Opposite sides of opening sides of the fences F and F' are provided with guide devices 10 and 10 which vertically guide the defensive wall 2 and strongly holds the same at a lifted position. The guide devices 10 and 10 comprise guide grooves 12 and 12 having predetermined width formed by a pair of flanges 11 and 11. The pair of guide grooves 12 and 12 are opposed to each other and extend from upper ends of the fences F and F' to the predetermined position of the machine rooms M•R. Convex members 6 and 6 of the defensive wall 2 come into slide contact with the guide grooves 12 and 12 and are guided by the grooves 12 and 12.

Next, the operation of the embodiment will be explained. In a normal state, a function of the check valve is canceled, and a state of the cross valve 34 shown in FIG. 1 is switched to a state in which water can be discharged. With this operation, water in the first and second water pressure type piston cylinder units 20 and 20 is discharged into the ditch D through the check valve and the cross valve 34. The defensive wall 2 is lowered until it abuts against the support member or the stopper by its own weight (this state is not shown in FIG. 1), and the top 4 of the defensive wall 2 comes to substantially the same height as that of the road surface R. With this, the top 4 of the defensive wall 2 becomes a portion of the road surface R, and people can go in and out without unconsciously.

The cross valve 34 is switched to the position shown in FIG. 1 when necessary, and the open/close valve 32 is opened. With this, the running water is equally supplied to the first and second water pressure type piston cylinder units 20 and 20 from the feed pipe 31 by the above-described reason. The second water pressure cylinder 22 and the piston 25 are driven upward. Therefore, the defensive wall 2 is driven to the upper predetermined position. With this, entry of the mob, runaway vehicle, running water and the like is prevented. Although it is not illustrated in FIG. 1, stoppers for limiting an upward moving amount of the defensive wall 2 are mounted to the first and second water pressure type piston cylinder units 20 and 20 or the guide devices 10 and 10. Therefore, even if supply of the running water is continued, the defensive wall 2 stops at the predetermined position. At that time, since the pressure of the running water is relatively low, the first and second water pressure type piston cylinder units 20 and 20 are not destroyed. A relief valve may be provided in the feed pipe 31 for safety if necessary.

Figure 2:
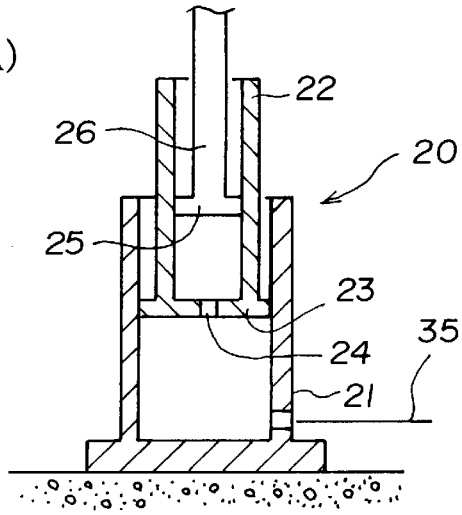
FIG. 2 show the embodiment of the invention, wherein 2(A) is a sectional view of an embodiment of a water pressure type piston cylinder unit, and 2(B) is a schematic perspective view of an essential portion of a second embodiment of the invention.
Figure 2:
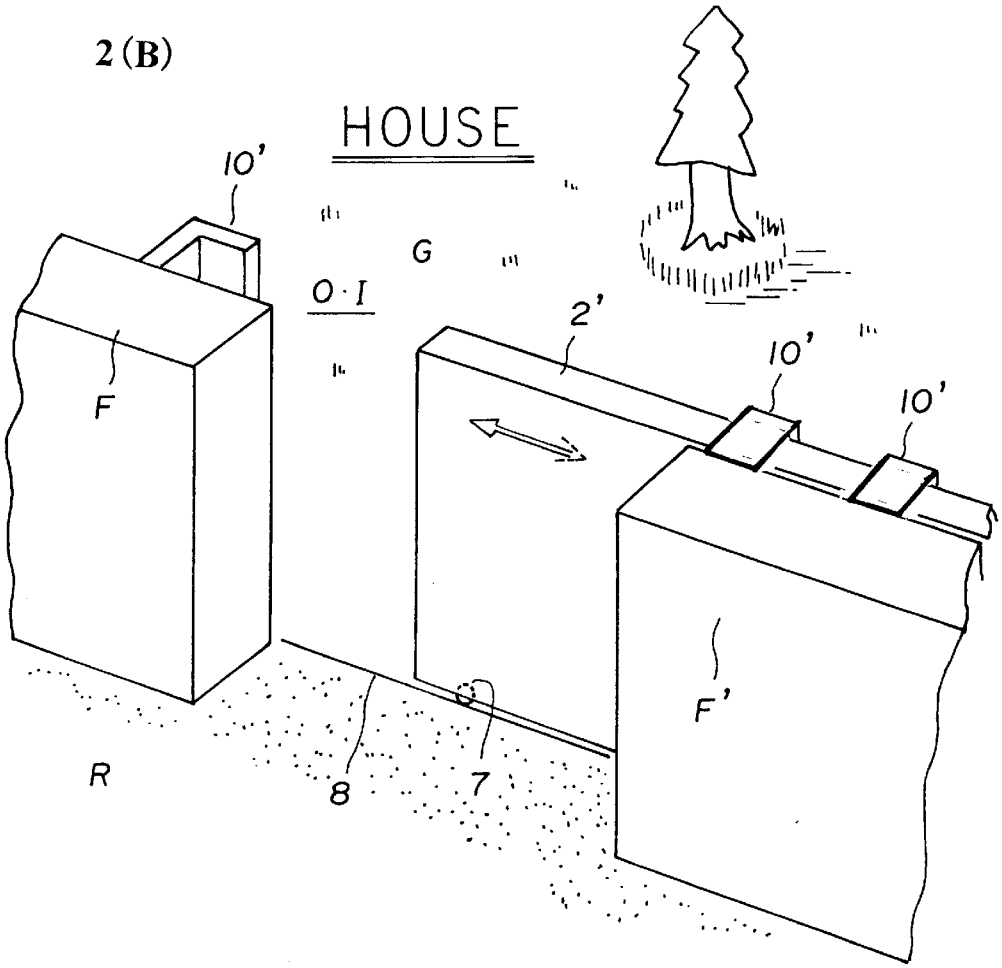

Next, a second embodiment of the present invention will be explained with reference to FIG. 2(B). The same constituent elements as those in the first embodiment are designated with the same reference numbers or characters, or dash "'" is added to the reference numbers or characters, and the same explanation is omitted. According to the second embodiment, a defensive wall 2' is provided along one of the fence F', and the defensive wall 2' is slidably driven in the horizontal direction toward the other fence F. Therefore, the one fence F is provided with a stopper-guide member 10', and the other fence F' is provided with guide devices 10' and 10'. A rail 8 on which wheels roll is provided on the road surface R. According to the second embodiment, since the defensive wall 2' is driven in the horizontal direction, a water pressure type piston cylinder unit which is driven in two directions, i.e., an opening direction and a closing direction is provided. It is apparent that the second embodiment achieves the same operation as the first embodiment.

The present invention is not limited to the above embodiments, and can be carried out in various manners. For example, when the feed tank is disposed at a high place such as a building, if the feed pipe 31 is connected to the feed tank, even if the running water is stopped, the defensive wall 2 can be driven. If a running water tank, a disaster prevention tank or the like is provided, the feed pipe 31 may be connected to such tank. If a water pipe connected to the feed tank, running water tank or the like is connected to the water supply pipe side-by-side, there is merit that the defensive wall 2, 2' can be driven by any of the tanks in case of an emergency. A pressure compensation type flow rate adjusting valve may be provided instead of the orifices 36 and 36 so that equal amount of water can be supplied to the first and second water pressure type piston cylinder units 20 and 20. It is apparent that the number of water pressure type piston cylinder units is not limited to that shown in the embodiments. According to the embodiment, although the running water is supplied to the water pressure type piston cylinder units 20 and 20, water pressure of the running water is not high. Therefore, the water pressure type piston cylinder units 20 and 20 can be made of reinforced plastic which is not subject to corrosion. In that case, maintenance of the unit is easy.

The doorway O•I is not provided with the gate in the first and second embodiments, but the gate is necessary, it is apparent that the gate can be provided at inside or outside side-by-side as described above. The water pressure type piston cylinder unit of the embodiments can be mounted to an existing defensive wall. In the above embodiments, the unit is provided in relation with the fences F and F', but the unit can be provided on an open/close door of a doorway or window of a building in the same manner irrespective of fences F and F'. With this, it is apparent that the entry of mob into the house can be prevented. In the first embodiment, a returning-preventing mechanism, e.g., a ratchet mechanism which can manually be opened may be provided so that the defensive wall 2' which is driven upward may be held at the position each time.

Material of the defensive wall 2, 2' is not specified in the embodiments, the defensive wall may be made of a corrugated copper plate. The copper plate is light in weight and has rigidity and thus, can sufficiently endure collision of a heavy vehicle. The top 4 of the defensive wall 2 has the same color as that of the road surface R so that defensive wall 2 and the site can not be distinguished by means of color.

As explained above, according to the present invention, the movable defensive apparatus comprises a defensive wall disposed in the vicinity of a doorway of a site such as a house and an installation or in the vicinity of a doorway, a window or the like of a building for preventing rainwater and illegal object such as a mob and a runaway vehicle from entering the site or the building; and a drive device for driving the defensive wall from a storage position to a predetermined position along a guide device, and the drive device comprises a piston cylinder unit which is operated by water pressure such as running water and reserved water. Therefore, even in case of emergency such as power failure, the defensive wall can be driven to the predetermined position only by supplying running water which is less prone to be stopped or reserved water at the time of water-outage to the water pressure type piston cylinder unit. Therefore, the invention exhibits specific feature that it is possible to reliably prevent rainwater and illegal object such as a mob and a runaway vehicle from entering the site or the building in case of an emergency such as a war or a disaster.

What is claimed is:

1. A movable defensive apparatus comprising a defensive wall in the vicinity of an access opening to a building for preventing undesirable elements from entering the building;

and a drive device for driving the defensive wall from a storage position in a basement of the building to a predetermined position along a guide device, wherein said drive device comprises a piston cylinder unit which is operated by water pressure.

2. A movable defensive apparatus comprising a defensive wall in the vicinity of a doorway between a fence and another fence surrounding a building for preventing undesirable elements from entering the building; and a drive device for driving the defensive wall from a storage position in a side surface of the fence, wherein said drive device comprises a piston cylinder unit which is operated by water pressure.

3. A movable defensive apparatus according to claim 1, wherein said defensive wall is provided in the vicinity of a doorway between a fence and another fence surrounding said building.

4. A movable defensive apparatus according to claim 1, wherein said defensive wall is provided in the vicinity of an open/close access opening of the building.

5. A movable defensive apparatus according to any of claims 3, 4, 1 and 2, wherein said piston cylinder unit is a telescoping unit.

6. A movable apparatus according to any one of claims 3, 4, 1 and 2, wherein a valve for controlling water pressure to be supplied to said piston cylinder unit is provided in the building.

* * * * *